United States Patent [19]

Henschen

[11] 4,178,828

[45] Dec. 18, 1979

[54] COMPUTERIZED UNIT ORGAN RELAY

[76] Inventor: Lawrence J. Henschen, 780 S. Warrington Rd., Des Plaines, Ill. 60016

[21] Appl. No.: 820,149

[22] Filed: Jul. 29, 1977

[51] Int. Cl.[2] ..... G10B 3/10

[52] U.S. Cl. ..... 84/337; 84/345; 84/338

[58] Field of Search ..... 84/370, 342, 343, 344, 84/1.01, 1.02, 1.03, 337, 345, 341; 340/172.5; 364/900

[56] References Cited

U.S. PATENT DOCUMENTS

| | | | |
|---|---|---|---|
| 3,138,052 | 6/1964 | Wick | 84/337 |
| 3,379,085 | 4/1968 | Burton | 84/337 |
| 3,501,990 | 3/1970 | Jappe | 84/337 |
| 3,548,064 | 12/1970 | Oncley | 84/1.01 |
| 3,686,994 | 8/1972 | Badessa | 84/345 |
| 3,699,839 | 10/1972 | Denigan | 84/345 |
| 3,700,784 | 10/1972 | Molnar | 84/345 |
| 3,733,593 | 5/1973 | Molnar | 340/172.5 |
| 3,903,778 | 9/1975 | Ferch | 84/341 |
| 3,926,087 | 12/1975 | Griffis | 84/345 |
| 4,031,786 | 6/1977 | Kaplan | 84/1.03 |

*Primary Examiner*—L. T. Hix
*Assistant Examiner*—S. D. Schreyer
*Attorney, Agent, or Firm*—Snider, Sterne & Saidman

[57] ABSTRACT

A computerized unit organ relay which utilizes computer hardware and software to interconnect the pipes of the organ with the organ console in such a fashion that the proper pipes are activated in response to the key-stop combinations designated at the console. All of the keys of the various keyboards, and their associated stops, are connected through appropriate input ports to the data processing device which, in a preferred form, comprises a programmed microcomputer. The computer software acts on the input data from the keys and stops to calculate which of the pipes should be activated in response to actuated keys and stops. This information is stored in a continuously updated array and is read out of the computer memory, via appropriate output interface devices, to activate the corresponding pipes of the organ.

20 Claims, 6 Drawing Figures

$a_0$-$a_7$
$a_8$-$a_{13}$
TO OUTPUT LATCH
28'
RAM
42
$a_{14}$
PROM
40
44
LOWER ORDER ADDRESS --- 8 BITS
DEVICE SELECT DERIVE FROM HIGH ORDER ADDRESS
46
1 OF 8 DECODER
38
$a_{15}$
SYSTEM CONTROLLER
32
33
DATA BUS
34
CENTRAL PROCESSOR
TIMING SIGNAL
36
CLOCK GENERATOR
DATA BUS
COMPUTER
30
28
26
24
SP1
SP2
SP15
STOP DATA PORTS
KP1
KP2
KP61
KEY DATA PORTS
INPUT DATA PORTS
22
$S_1$ $S_2$ $S_3$ $S_4$
$S_5$ $S_6$ $S_7$
$S_8$ $S_9$ $S_{10}$ $S_i$
STOPS
20
61
$KB_1$
$KB_2$
$KB_M$
KEYS
18

COMPUTERIZED UNIT ORGAN RELAY

BACKGROUND OF THE INVENTION

1. Field of the Invention

The present invention is related to pipe organs and, more particularly, is directed towards an electronic data processing system designed to perform the relay function of a unit pipe organ.

2. Description of the Prior Art

A pipe organ is a musical instrument in which sound is produced by passing compressed air through pipes. The selection of the particular pipes is controlled by a console that comprises a number of keyboards, as well as a set of stops for each keyboard.

More particularly, the pipes of the organ are organized into a plurality of rows, called ranks, and a plurality of columns. Each rank represents a different tone type which may be produced by the particular organ, such as, for example, flute, diapason, violin, horn, and the like. Within each rank, each of the pipes has a different length, in order to produce the different notes within the particular tone type, and thus each rank contains at least 61 pipes (spanning 5 octaves and high C on a standard keyboard). Generally, however, most ranks contain more than 61 pipes, and means known as stops are provided on the console for selectively actuating a group of 61 pipes from within each rank for each keyboard, as will be explained in greater detail below. Within each rank, the pipes are also generally arranged in order of ascending pitch (descending length), with the first pipe being the longest pipe in the rank. Each set of pipes sits on a wind box or chest, and each pipe has its own magnetically controlled valve which, when actuated, allows air into the pipe.

On the console are provided a plurality of keyboards which generally include at least one keyboard playable by the feet called the pedal and a number of keyboards playable by the hands which are called manuals. The keys on the keyboards are arranged into groups of 12 and are labeled within each group C, C#, D, D#, E, F, F#, G, G#, A, A#, and B. Each succeeding group of 12 keys plays notes one octave higher than the preceding group. Typical pedal keyboards contain 32 keys which span two and one-half octaves, while typical manual keyboards contain 61 keys spanning five full octaves plus high C.

Each keyboard has its own set of stops associated therewith. Generally, each stop controls one rank of pipes playable on its keyboard. Turning a stop ON allows the 61 (or 32) keys on its keyboard to control 61 (or 32) corresponding pipes of the rank identified by the stop. When the stop is OFF, playing of a key on its associated keyboard will not effect any of the pipes in the rank of that stop, assuming no other stops in that rank are activated. Stops are labeled by the rank they control (e.g., flute, horn, etc.) and by the pitch of the lowest note of the set of pipes they control. The pitch labels are indicated by the approximate length of the lowest pitch pipe (longest length) in the set, and typical pitches are 32', 16', 8', 4', and the like.

In operation, the organist selects the tones and pitches he wishes to use for each keyboard by turning the corresponding stops ON. Then, when a key is pressed, all of the pipes corresponding to that key and the selected ranks and pitches will be sounded. When the key is released, all of those pipes will stop sounding, even though the stops remain actuated. It therefore may be appreciated that the stop switches and the key switches may be thought of as being connected in series such that both must be closed in order to actuate the corresponding pipe.

The basic structure of a pipe organ is schematically illustrated in FIG. 1 wherein reference numeral 12 designates the console having M keyboards 18 and i stops 20, reference numeral 14 designates the pipes arranged in m rows and n columns, reference numeral 16 indicates the wind chests having coil magnets for each of the potential ($m \times n$) pipes, and reference numeral 10 indicates a set of relays which transform the key-stop combinations designated on a console 12 into signals for actuating the appropriate coil magnets 16 to sound the corresponding pipes 14.

A unit pipe organ is one in which the same set of pipes may be controlled from several keyboards and at several different pitches. Thus, referring to FIG. 1, rank 3 is playable at 16' pitch on both keyboard 1 and keyboard 2, and in addition rank 3 may be played at 8' on keyboard M. If, for example, stop S3 is actuated, the 61 keys on keyboard 1 will cause pipes in columns 1 through 61 in rank 3 to sound, respectively, assuming that the lowest pitch pipe in rank 3 is 16'. The same sounds would be produced by actuating stop S6 and hitting the corresponding keys on keyboard 2. In contrast, actuation of stop S10 will enable the pipes in columns 13 through 73 of rank 3, since stop S10 is an 8' stop and begins therefore exactly one octave above stops S3 and S6. Thus, the 61 keys of keyboard M will serve to actuate pipes 13 through 73, respectively, in rank 3. If both stops S6 and S10 are enabled, actuation of the 13th key on keyboard 2 simultaneous with the actuation of the first key on keyboard M will cause the same pipe (rank 3, column 13) to play. Naturally, the stops, keyboards and pipes illustrated in FIG. 1 are simplified for the sake of explanation; clearly, many other stops-key combinations and configurations are possible.

As explained above, the relays 10 illustrated in FIG. 1 perform the function of actuating the proper electromagnet in unit 16 in response to designated stop-key combinations on console 12. Mathematically, the relays may be said to perform an AND operation between the stops and the keys, and then an OR operation among all the stop-key combinations that can affect each pipe. Two forms of such relays are in known use today.

The traditional form of relay system includes electromechanical devices. Each stop operates a gang switch that closes 61 (or 32) switches in parallel. These closed switches act as one input to what may be thought of as a mechanical AND gate. The other input comes from the keys on the keyboard. The back sides of the gang switches are connected to common buses that lead to the pipes. Thus, turning a stop on and pressing a key will produce a TRUE output signal from the AND gate which is sent to the corresponding pipe. Since, in a unit organ, there may exist many of such true signals from different stop-key combinations for a given pipe, they are each tied to a common bus, in what may be thought of as a mechanical OR gate, that leads to the pipes.

In such electromechanical systems, the magnets that allow air to the pipes are driven directly by the bus. Moreover, the contacts are all open air contacts. This, in turn, requires spreader relays to be used for the keys, and also calls for fairly high quality material to be used throughout, which in turn makes electromechanical relays relatively expensive.

Electromechanical systems are also quite large. For example, a typical keyboard relay will occupy a space many feet square by a foot deep. This size is due in part to the large number of individual wires that interconnect the keyboard relay to the gang switches. For example, for a manual keyboard having 15 stops, there are 61 wires leading from the keyboard to the relay, and $(15\times61)=915$ wires leading to the gang switches. Typical gang switches are 10 to 12 inches long and several inches high. Since a moderately sized organ can have a hundred stops, and hence a hundred gang switches, this section of the total relay can also occupy many cubic feet, again requiring space enough for $(100\times61)=6,100$ wires leading in, and one wire leading out for each pipe. In larger unit organs, the two sections (the keyboard relay and the gang switches) can occupy an entire room.

Recently, systems that replace the mechanical devices with integrated electronic circuits have been marketed. Such circuits adhere to the basic design set forth above, except that electronic AND gates replace the key-to-gang switch connections, and OR gates tie the AND outputs to a signal to the pipe. Clearly, for a one hundred stop organ, 6,100 individual AND gates and a large number of OR gates are required, in addition to circuit boards, and the like, which tends to make the electronic systems also somewhat expensive.

I am aware of several U.S. patents which teach the utilization of electronic circuitry for pipe organs. For example, U.S. Patents to Wick and Burton (Nos. 3,138,052 and 3,379,085) teach the utilization of transistors and related circuitry to actually drive the coils in place of the mechanical, open-air switches of the prior art.

Other U.S. patents deal with combination actions, which are devices that change the stop settings in response to the actuation of a member known as a piston. Pistons permit the organist to change the stop setting during the performance of a piece of music in order to achieve a different sound quality. Since such a change may involve 30 to 50 or more stops, electromechanical pistons were evolved to permit the stops of all be changed in an instant. U.S. Patents to Oncley (No. 3,548,064), Badessa (No. 3,686,994), Denigan et al (No. 3,699,839), and Molnar (3,700,784 and 3,733,593) all relate to the replacement of such electromechanical devices by solid state electronic devices for effecting a change in stop settings when a piston is pressed. The U.S. Patent to Griffis (No. 3,926,087) utilizes a programmed computer for this purpose, and some of the patents include a means for changing the memory (i.e., means for changing the pattern of ON and OFF stops for each piston).

The U.S. Patent to Jappe et al (No. 3,501,990) deals with the replacement of electromechanical relays by solid state devices. More particularly, Jappe et al utilize a set of 61 transistors to replace the 61 contact mechanical gang switches of the relays. The emitters of all 61 transistors are connected to the stop. The collectors of the various transistors from different keys that control the same pipe are also interconnected, and each key must be connected to the bases of as many transistors as there are stops for that keyboard. Closing a particular stops connects all 61 emitters to a source. Then, when a key is played, the transistor in series therewith is energized to actuate the series connected coil. While an improvement over electromechanical devices, the solid state type of relay taught by Jappe et al still requires 61 transistors for every stop, thereby leading in turn to complex wiring schemes and attendant high costs.

I am also aware of U.S. Pat. No. 3,903,778 to Ferch which teaches electronic couplings and actuation circuits for a multi-keyboard instrument.

OBJECTS AND SUMMARY OF THE INVENTION

It is therefore a primary object of the present invention to provide a novel, unique and improved means for performing the relay and switching functions on a unit pipe organ.

Another object of the present invention is to provide a new and improved means for performing the relay and switching function of a unit pipe organ which does not require electromechanical devices in its implementation thereby substantially reducing the amount of space required to house the relay system.

Another object of the present invention is to provide a novel and unique unit organ relay system which may be produced and provided for substantially less cost than presently available systems.

A still further object of the present invention is to provide a new and improved unit organ relay system which may be easily modified and adapted to any existing organ design, which is compact and inexpensive, which is highly reliable in operation, and which may perform the necessary relay and switching functions in suitably fast time.

The foregoing and other objects are achieved in accordance with one aspect of the present invention through the provision of relay means comprising a programmable data processor connected between the console of the organ and its air-actuated pipes. The data processor operates under the control of a program for calculating which of the pipes should be actuated in response to the key-stop combinations designated on the console. Input interface means are connected to the data processor and include first means for receiving an input in response to the actuation of each key, and second means for receiving an input in response to the actuation of each stop. Output interface means are connected between the data processor and the air-actuated pipes for actuating the appropriate pipe in response to the output calculations of the programmable data processor.

In accordance with more specific aspects of the present invention, the program controlled data processor comprises read-only-memory (ROM) means for storing the program, central processing means connectd to the ROM and to the first and second input receiving means for operating on the inputs in response to the program instructions to calculate the output as well as to generate appropriate address signals, and random-access-memory (RAM) means connected to the central processing means for storing the output and for feeding same upon demand to the output interface means.

In accordance with other aspects of the present invention, the first means of the input interface means comprises a plurality of first input ports each connected to read a single keygroup from the plurality of keyboards, while the second means comprises a plurality of second input ports each connected to read a single stopgroup from the plurality of stops. More particularly, the output interface means comprises a plurality of data latches each connected in parallel to receive the output calculations from the data processor. Each of the outputs of the data latches are connected to an individual electromagnet for actuating its corresponding pipe from among the plurality of pipes. The output interface means further comprises a plurality of decoders that are connected to receive the address signals from the central processing means for controlling the sequential actuation of the plurality of data latches.

In accordance with another aspect of the present invention, a method is provided of controlling the actuation of a plurality of air pipes in response to particular key-stop combinations in a pipe organ, which comprises the steps of reading the setting of all stops into a electronic data storage device, and successively testing each key on the plurality of keyboards to see if it is actuated. For each key found actuated, a logical AND operation is performed between the actuated key and certain of the stop settings. The results of the logical AND operations are then fed to means for controlling the actuation of the plurality of air pipes.

More specifically, the method of the present invention includes the steps of arranging the stop settings into stop groups, each of the stop groups having a predetermined pitch associated therewith, and reading the stop group settings into a first data array in the electronic storage device. The corresponding pitch for each such stop group is arranged in a second data array which is also stored in a memory device. The pitch for each stop group is defined by the number of pipes between the first pipe in the stop group and the lowest pitch pipe within the rank of pipes that contains the stop group. The method of the present invention further comprises the step of establishing a third array of data in the memory device which corresponds to the desired condition of each of the air pipes, the rows of the third data array corresponding to the rank of the air pipes, the individual columns of the third array identifying a particular pipe in each of the ranks.

In accordance with yet other aspects of the present inventive technique, the step of performing a logical AND operation includes the steps of identifying from the first data array those stop groups containing stops that correspond to the actuated key, and successively performing the logical AND operation between each identified stop group and the actuated key. The step of successively performing a logical AND operation between each identified stop group and the actuated key further includes the steps of determining the desired pipe to be actuated by adding to the positional value of the actuated key the value from the second data array that corresponds to the pitch of the identified stop group, the sum thereof defining one of the columns in the third data array. The defined column in the third data array is updated by performing a logical OR operation between the previously stored data for the column and the data from the first data array that corresponds to the identified stop group.

In accordance with other aspects of the present invention, the step of successively testing each key includes the steps of grouping all of the keys from the plurality of keyboards into 61 keygroups, each keygroup consisting of all like notes from the plurality of keyboards, and successively testing each key by first checking each keygroup and then testing each key within the keygroup.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
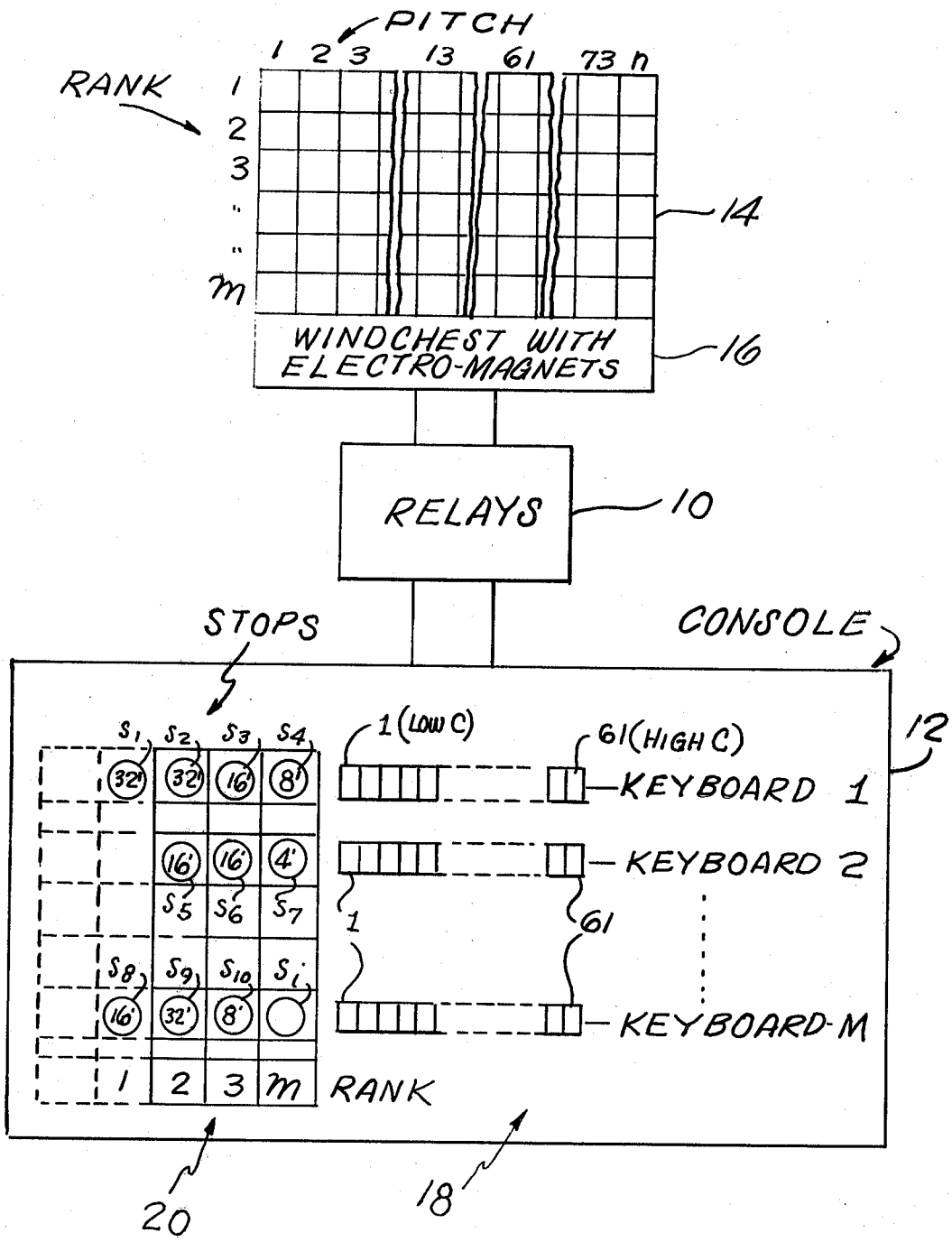
FIG. 1 is a schematic block diagram which broadly illustrates the several components of a standard pipe organ.

The present invention broadly comprises means for replacing the electromechanical and solid state relays 10 of the prior art unit type organs, as illustrated in FIG. 1, with a programmable data processor operating under the control of a suitable program for actuating the appropriate pipes in response to key-stop combinations indicated on the console.

Figure 2A:
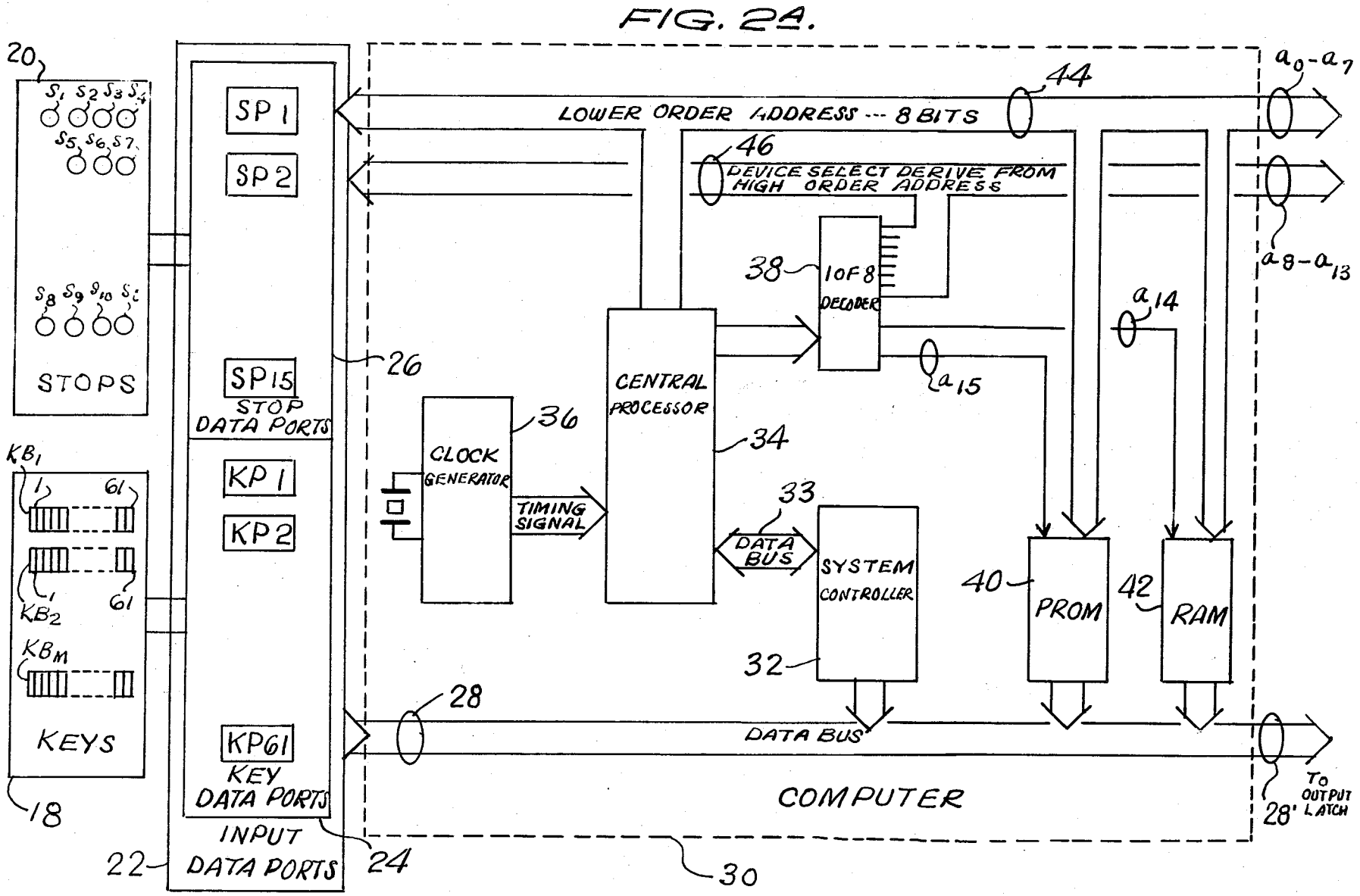
FIGS. 2A and 2B comprise a functional block diagram of a preferred embodiment of the present invention.

Preferably, the data processor comprises a microcomputer 30, as illustrated in FIG. 2A in block functional form, which includes a programmable read-only-memory (PROM) 40 that contains the program or software that specifies the AND, OR, READ, WRITE and related operations necessary to calculate which pipes of the organ should play and which pipes should not. The calculated values are stored in a random-access-memory (RAM) 42 and are read out along data bus 28' at the appropriate time.

Broadly speaking, as will be described in more detail hereinbelow, the basic cycle of operation of the software and hardware of the present invention begins by establishing an array in the random-access-memory 42 which contains one space corresponding to the state (i.e., ON or OFF) of each pipe in the organ. All of such memory locations are initialized by setting same to "0" (i.e., OFF). The computer 30 then reads the setting of the stops 20 and keys 18 via the input data ports 22. The computer 30 then compares the stop settings and keys, and for each combination thereof which are both ON the computer sets the corresponding memory location in the pipes array in RAM 42 to a logical "1" (i.e., ON). When all the combinations have been processed, the computer copies the calculated pipe signals stored in RAM 42 to output interface hardware illustrated in FIG. 2B which connects the signals to the pipes of the organ. The process is then repeated, at least every 0.01 second.

Referring now to FIG. 2A, reference numeral 18 indicates the various keys of the M keyboards KB1, KB2, . . . , KBM, which may be thought of as comprising part of a typical pipe organ. As used herein, the term "keyboard " shall be taken to mean manual keyboards and/or pedal boards, the former of which normally have 61 different keys associated therewith, the latter of which have 32 keys associated therewith.

The keys 18 of the M keyboards are connected to 61 key data ports 24 which are individually labeled KP1, KP2, . . . , KP61. The key data ports 24 are connected to the keys 18 in such a fashion that each port is coupled to the same key (note) on each keyboard.

Figure 3:
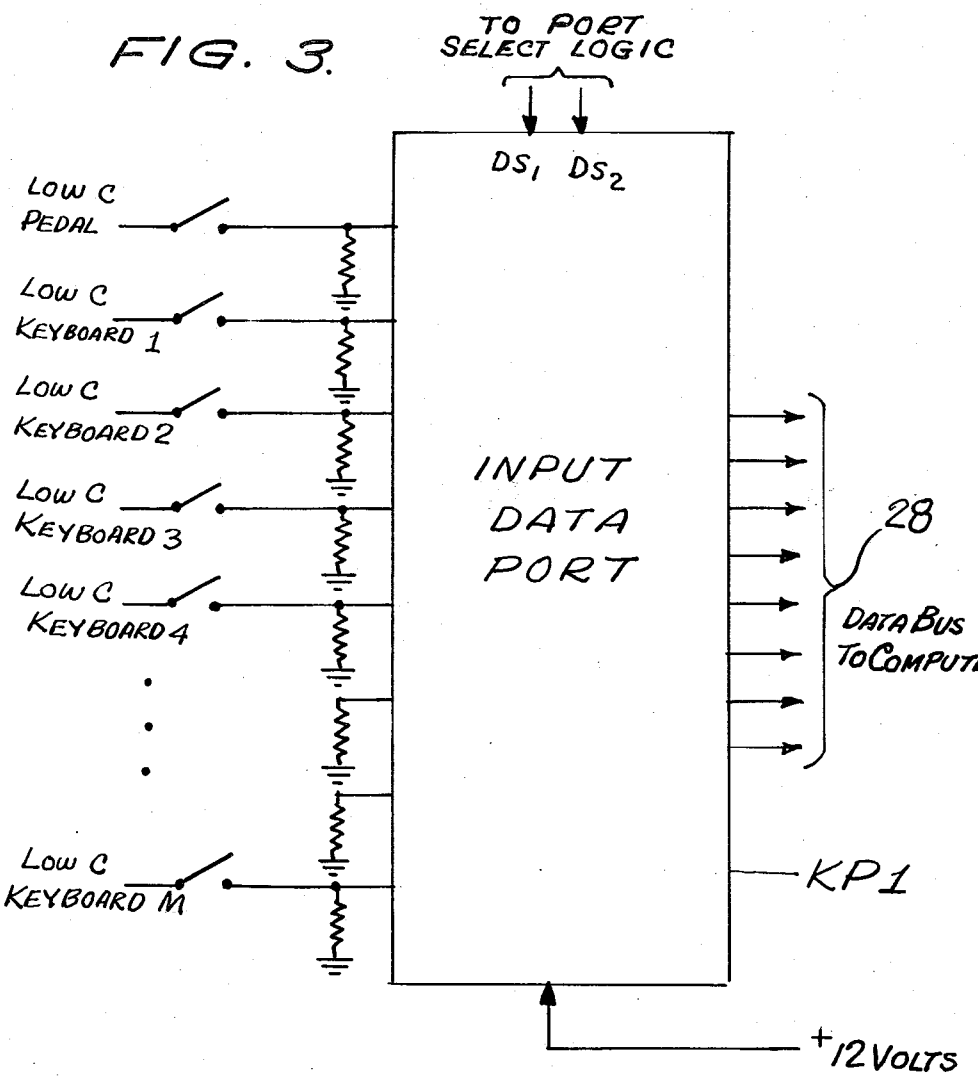
FIG. 3 is a more detailed view of one component of the present invention from FIG. 2A.

The relationship between the keys 18 and the key data ports 24 may be better understood with reference to FIG. 3 which illustrates data port KP1 and its input connections to all of the "low C" keys of all the keyboards KB1 (the pedal) through KBM. The input data port KP1 chosen for illustration has an 8-bit input and an 8-bit output, the latter of which is connected to the data bus 28 to be fed to the computer 30. Each port is also provided with port select inputs DS1, DS2, which, under the control of the computer 30, permit port KP1 to gain access to the data bus 28. In other words, when the port select logic from the computer selects port KP1, the keyboard signals on the left of the port are driven through the port to the data bus 28 and into the computer.

As stated above, in the preferred embodiment there exists 61 input data ports KP1, . . . KP61, each one of which is connected to one of the 61 notes on all of the keyboards KB1, KB2, . . . , KBM. The 8-bit ports selected for illustration therefore enable a pipe organ with up to eight keyboards to be accommodated.

Referring back to FIG. 2A, the stops 20 of the organ are similarly connected to a plurality of stop data ports 26 in the interface unit 22. One of the stop data ports SP1 is illustrated in greater detail in FIG. 4 and is seen also to comprise an 8-bit input, 8-bit output port, the input bits being connected to eight individual stops S1 through S8, the output being connected to the data bus 28 of the computer. Access to the data bus 28 is also achieved via a pair of port select inputs DS1 and DS2. The number of 8-bit stop data ports required for a particular organ obviously depends upon the total number of stops. Clearly, the fifteen stop data ports 26 illustrated in FIG. 2A will easily take care of 120 stops S1, S2, . . . , S120.

Information between the microcomputer 30 and the input interface units 22 is fed via a data bus 28 and a device select bus 46. The microcomputer 30 is basically comprised of a number of standard integrated circuit chips which are interconnected in a known manner to perform the desired computations. The microcomputer 30 includes a programmable read-only-memory (PROM) 40 which contains the program that runs the computer. In a typical microcomputer, the program may be loaded into the PROM 40 by an external device before PROM 40 is plugged into the computer 30.

A random-access-memory (RAM) 42 is a read/write memory which holds the data that is calculated, i.e. RAM 42 contains the results of the calculations which indicate which of the pipes in the organ are to be actuated.

The microcomputer 30 includes a central processor 34 which performs the actual operations, decodes instructions, generates cycle-start signals, control information, 16-bit addresses, and the like. At the beginning of an instruction cycle, the processor 34 retrieves an instruction from read-only-memory 40. An instruction consists of an operand byte and possibly either one byte of data or two bytes of address. The data from either the input ports 22 or the RAM 42 is then fetched via the data bus 28 and a system controller 32, and finally the processor 34 operates on the data. This cycle is repeated for the next instruction from PROM 40.

The operation of the processor 34 depends on receiving accurately timed, overlapping signals from a clock generator 36. The preferred clock generator 36 utilizes a crystal oscillator to establish a time base and generates the necessary signals at the required voltage levels for the processor 34.

A system controller 32 is connected to the processor 34 via a data bus 33. The system controller 32 provides accurate activation signals to the input devices, output devices, and memory devices based upon the kind of instruction received at the processor 34. Also, the actual data is channeled through the system controller 32 which also provides sufficient power to drive a multiplicity of input and output devices.

A decoder 38 is connected to the central processor 34 and receives therefrom a 3-bit binary number from 0 to 7 and produces an active signal on one of 8 output lines. One of the output lines $a_{15}$ is connected to PROM 40, another $a_{14}$ is connected to RAM 42, while the remaining lines $a_8$–$a_{13}$ are connected to the input and output devices. Since each of the peripheral devices are capable of internally decoding an 8-bit address, the lower order 8-bits ($a_0$–$a_7$) of the 16-bit address generated by central processor 34 are bussed to all such devices. The decoder 38 then uses the first 3 bits of the high order half of the 16-bit address to select one of such devices to be active. Thus, while all peripherals are connected to the same data bus 28, 28', as well as the lower order address bus 44, only one such device is active at any time.

Figure 2B:
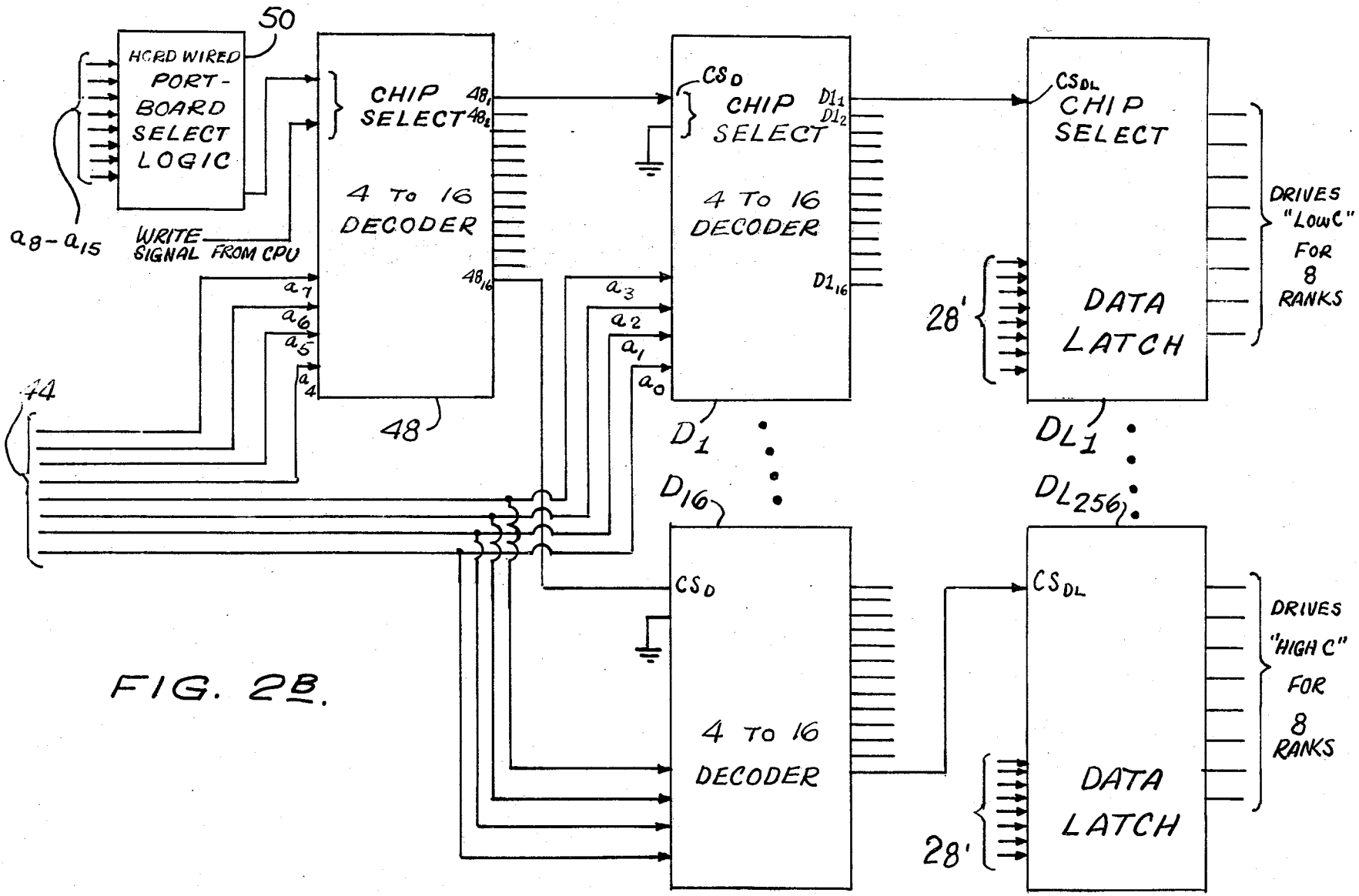

Referring now to FIG. 2B, there is illustrated the interface hardware between the computer 30 and the electromagnets that control the actuation of the pipes of the organ. As mentioned briefly above, the hardware illustrated in FIG. 2B serves to distribute the calculated data for the pipes from RAM 42 via data bus 28' to the plurality of individually operable pipes. There is provided in the preferred embodiment a single 4-bit to 16-bit decoder 48 which has as a data input 4 of the lower order address bits $a_4$–$a_7$ to send an output along one of its 16 output lines $48_1$, $48_2$, . . . , $48_{16}$.

Each of the 16 outputs from decoder 48 are connected to a single chip select input $CS_D$ of 16 additional 4-to-16 decoders D1, . . . , D16. Each of the decoders D1, . . . , D16 are connected to receive a 4-bit data input comprised of the remaining 4 lower-order address bits $a_0$–$a_3$. The chip select inputs $CS_D$ for each of the decoders D1, . . . , D16 select one of the 16 decoders to receive the lower order data bits from address bus 44 for decoding.

Each of the decoders D1, . . . , D16 has 16 individual output lines, such as lines $D1_1$, $D1_2$, . . . $D1_{16}$ for decoder D1, which are, in turn, each connected as a chip select input $CS_{DL}$ for one of 256 output data latches DL1, . . . , DL256. Each of the output data latches DL1, . . . , DL256 is connected to receive as its input the 8-bit data from data bus 28' from the computer 30, and has an 8-bit output for delivering the data from bus 28' when the particular chip is selected by its chip select input $CS_{DL}$. The 8-bit outputs of the 256 data latches DL1, . . . , DL256 are connected directly to the controlling electromagnets in the wind chests of the pipes. Thus, the preferred embodiment is capable of handling $256 \times 8 = 2{,}048$ pipes in an organ. The hard wired portboard select logic 50 guarantees that the board will react only to valid addresses of output ports.

While many possible combinations of elements will perform the desired functions as illustrated in FIGS. 2A and 2B, the best mode presently contemplated by me for carrying out my invention utilizes the following components:

| Component | Model Number |
|---|---|
| Key Data Ports 24, Stop Data Ports 26, and Output Data Latches DL1, . . . ,DL256 | INTEL 8212 8-bit Data Latch |
| Processor 34 | INTEL 8080 A-1 Micro-computer |
| Clock Generator 36 | INTEL 8224 Phased Clock Generator |
| System Controller 32 | INTEL 8228 Interface Chip |
| Random-Access-Memory 42 | INTEL 8102 (2102) RAM Memory Chip (1,024 8-bit Bytes) |
| Programmable Read-Only Memory 40 | INTEL 8702 (1702) ROM Memory Chip (256 8-bit Bytes) |
| Decoder 38 | INTEL 8205 1-of-8 Decoder |
| Decoders 48 and D1 through D16 | Motorola MC14514B 4-to-16 Decoder |

SOFTWARE

The manner in which the data is organized in the memory of the computer is derived from the logical organization of the pipe organ itself. With respect to the pipes, it is first noted that each rank (1, 2, . . . , m; FIG. 1) normally begins with the low C pipe. As illustrated in FIG. 1, the pipes may be thought of as forming a two-dimensional array, each row corresponding to one rank, each column corresponding to one pitch. For the purposes of the program, the rows of the pipes are divided into groups of eight to match the word length of the computer used in the preferred embodiment (8 bits per word). The total number of 8-bit word groups needed to represent all the pipes is denoted by P in the flow chart illustrated in FIG. 5. In the preferred embodiment of the hardware illustrated in FIG. 2B, P=256. A data array called PIPES (I), I=1, . . . , P is established in the random-access-memory 42 and holds the calculated values regarding which of the pipes of the organ should be on and which should be off in response to particular key-stop combinations.

As noted above and illustrated in FIG. 3, all of the keys from the various keyboards that represent the same note are grouped together into one keygroup. Thus, all "low C" keys connected to data port KP1 may be read with one input command. Clearly, there are 61 keygroups, while the total number of keyboards is denoted by the letter M. Each of the 61 keygroups therefore contains M values for the M different keys in that group.

Figure 4:
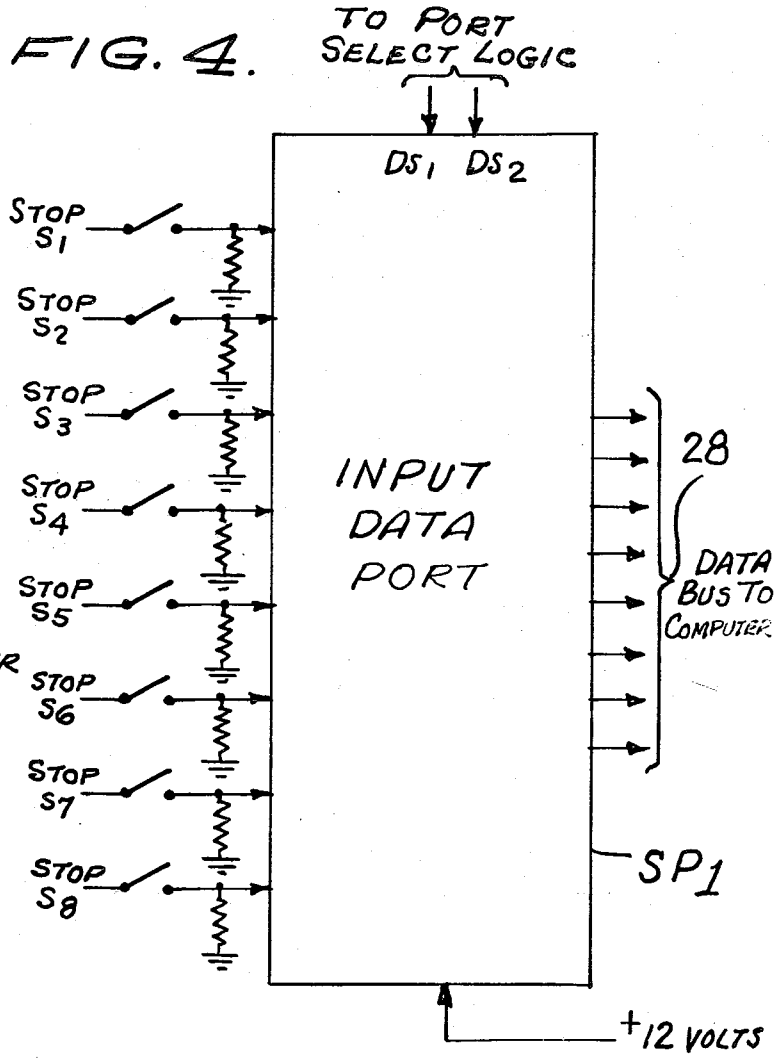
FIG. 4 is a more detailed view of yet another component of the present invention from FIG. 2A.

The stops are also grouped, first by keyboard. Then, within the group for a given keyboard, the stops are arranged by pitch. Finally, within a given pitch, the stops are arranged by the same grouping discussed above as for the PIPES array, as illustrated in FIG. 4. Each of the stop input ports, such as SP1, therefore provide an 8-bit word or stop group which corresponds to the settings of eight stops. If the total number of stop groups is denoted by S, a data array STOPS (I), I=1, . . . , S is established in RAM memory 42 for holding the stop group settings.

Another data array denoted OFFSET (I), I=1, . . . , S is established in the read-only-memory 40 at the same time that the program is established therein. The OFFSET array contains the permanent offset data for the stops for the particular organ being played. As noted above, since each stop activates 61 pipes from amongst a plurality of pipes in a particular rank, the particular pipes actuated by the particular stop may be identified by the pitch (approximate length) of the lowest (longest) pipe in its group. The offset for a particular stop group is therefore defined as the distance (in number of pipes) between the first pipe of the designated stop group and the lowest pitch pipe in the rank. Thus, for each of the S stop groups there exists a corresponding offset, which may be initially loaded in an OFFSET array, that identifies the distance of that stop group from the first pipe in the rank. Such distances are generally integral multiples of 12 (e.g. 0, 12, 24, 36, etc.).

If each keygroup is assigned a key number which is equal to the distance of the keygroup from low C, it may be appreciated that the offset in combination with the key number will define a particular column or pitch in the PIPES array for the particular stop-pitch-key combinations.

Finally, another pair of data arrays are established in the ROM memory 40 which may be denoted as FIRST (I), LAST (I), I=1, . . . , M. The FIRST and LAST arrays provide the first and last positions in the STOP-OFFSET array pair for the data for each keyboard, in a manner which will become more clear hereinafter.

Figure 5:
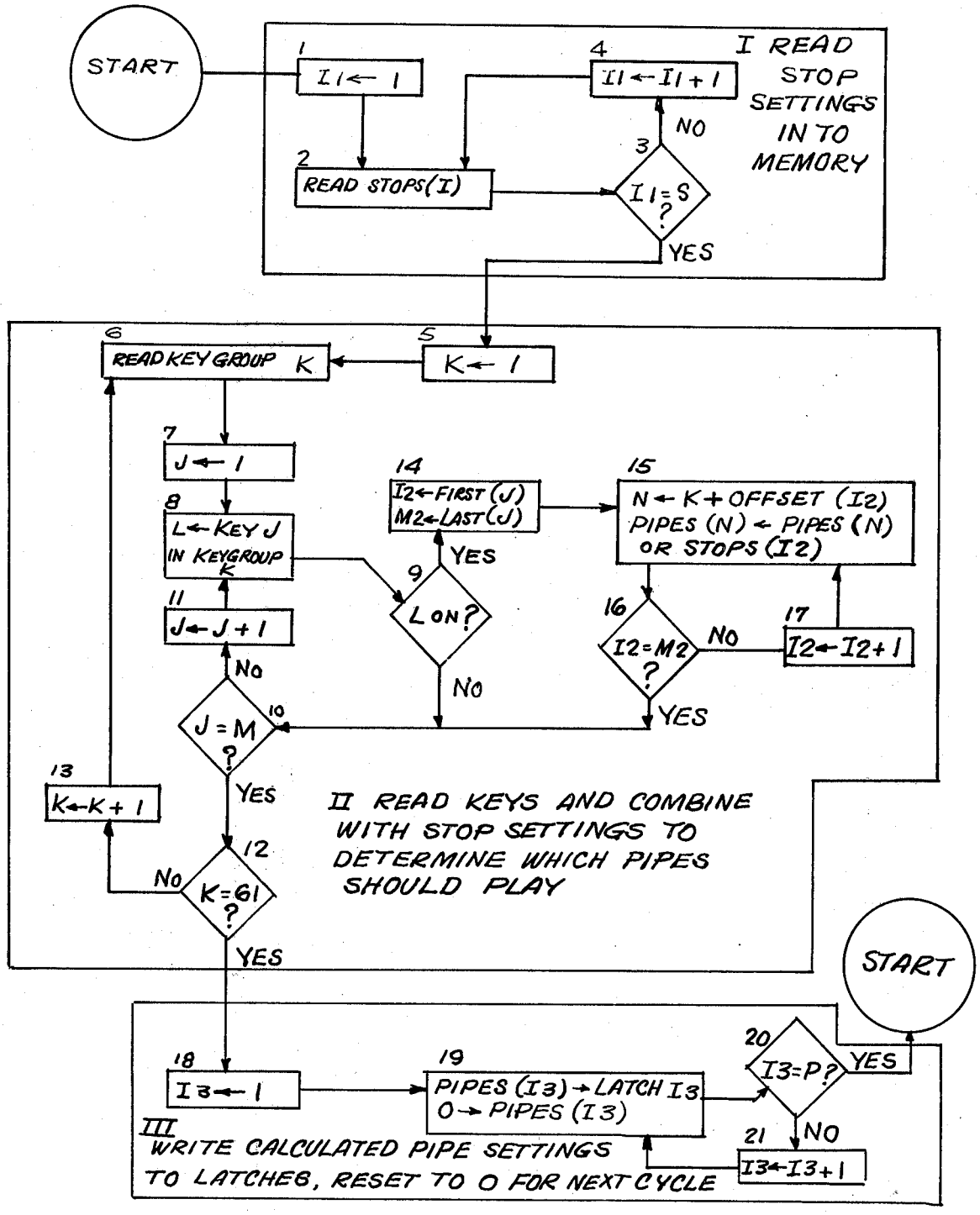
FIG. 5 is a detailed flow chart which illustrates broadly the programming logic and flow in accordance with a preferred embodiment of the present invention.

Referring now to FIG. 5, there is illustrated a detailed flow chart of a preferred program of the present invention which may be broadly divided into three major sections, to be discussed in order.

I. Read Stop Settings Into Memory

After the program has been loaded into the ROM memory, along with the OFFSET, FIRST and LAST data arrays, the computer proceeds with a program cycle that begins by reading all of the stop settings into memory, as follows:

1. Variable I1 is set equal to 1.
2. The first 8-bit stop group from input data port SP1 is read.
3. A test is conducted to see if all of the S stop groups have been read.
4. If not, the variable I1 is incremented by 1, and instructions 2 and 3 are repeated until all of the stop groups have been recorded in the STOPS array in the random access memory.

II. Read Keys and Combine With Stop Settings To Determine Which Pipes Should Play 5. All of the keys are individually examined to see if they are ON. This is accomplished by looking at each of the 61 key groups in turn, and initially the variable K is set equal to 1.
6. The first key group is read, and if any of e.g. the "low C" keys are actuated, the indication of same will be coupled through data port KP1 to data bus 28, as explained hereinabove.
7. J is a variable that represents the individual keyboards in the organ, which in this step of the program is initialized at 1.
8. L is a variable set to be equal to the read value of the Jth key in the Kth key group which is to be now individually examined.
9. A test is performed to see if L is ON (1) or OFF (0).
10. If L is off, we then test to see if we have looked at all the keyboards for the first (K=1) key group.
11. If not, we increment J by 1 to look at the next manual or pedal for key group 1, assign it to the variable L as in step 8, and test again in step 9 until all manuals and pedals have been tested for the Kth key group, at which point J=M and we go to the following step.

12. When J=M, we check to see if all of the 61 key groups have been tested. If so, we exit this portion of the program. If not, we continue to the next instruction.

13. We increment K to look at the next key group (e.g., K=2, low C#) and start the loop over again by reading the second key group at step 6 and testing each key on the successive keyboards to see if it is ON, as in steps 7, 8 and 9. It therefore may be appreciated that no calculations are made for any keys (regardless of the stop settings) without first having had an indication that a key is ON. Since, generally, a maximum of twenty percent of the keys can be ON at any given time, computation time is reduced measurably. When a key is found ON in step 9, the following procedure ensues.

14. Since we now know which key L has been activated in which key group K on a particular keyboard J, all we need to determine is which of the stops for that keyboard are ON, as well as the pitch of the particular stops found ON. Initially, to reduce computation time, we only examine those stop groups associated with the Jth keyboard. Accordingly, in this step, we let the variable I2 be set to the position in the STOPS array of the first such stop group for keyboard J in key group K, and the variable M2 is set to the position in the STOPS array of the last such stop group for keyboard J in key group K. We next simply look at those stop groups of interest (from I2 to M2) and if any stops are found activated, we place a logical "1" in the proper position in the PIPES array.

15. Initially, it should be noted that the proper position in the PIPES array will be defined by the key number K of the ON key, and the pitch of the actuated stop. Thus, if N corresponds to the column in the PIPES array that is effected by stop group I2, N may be determined by summing the key number K with the offset value for the I2th stop group.

Once the column of pipes of interest is located (N), we simply update the PIPES (N) information (for that column) by ORing the STOPS (I2) data with the presently stored data to yield a new PIPES (N). The latter will be stored in the RAM memory for future recall if and when N=K+OFFSET (I2) in a subsequent group.

16. When PIPES (N) is completed for STOPS (I2), we test to see if all M2 stop groups have been examined for key L (i.e., I2=M2?).

17. If not, I2 is incremented by 1 and a new column N of the PIPES array is determined depending on the key number K and the pitch of the (I2+1)th stop group.

The calculating loop is exited from instruction 16 when we have completed looking at all stop groups for the Jth keyboard having its Kth key ON. The loop exits to instruction 10 to check to see if we have examined all keyboards in our search for ON keys, and the program continues as in instructions 11 or 12 discussed above.

III. Write Calculated Pipe Settings To Latches. Reset To Zero for Next Cycle

18. When all 61 keygroups, all keyboards, and all stops and pitches have been calculated, the PIPES array contains the data corresponding to the desired condition of each of the pipes in the organ. This information is simply read out to the output latches in 8-bit groups by initializing the output variable I3=1.

19. The data in column 1 of the PIPES array is then copied to the first output data latch and then zeroed.

20. We test to see if all P columns of the PIPES array have been read, and if not, 21. We increment the variable I3 by 1 and proceed to read out the next column of the PIPES array to the next output latch. At the end of the cycle, the PIPES array will be 0 in preparation for the next input of key groups and stops data.

Thus, at the end of the 21-step program cycle just described, the output data latches DL1, . . . , DL256 (FIG. 2B) provide up to 2,048 signals (either ON or OFF) to the respective electromagnets that control the valves that allow air into the corresponding pipes. After all values have been copied out, which occurs in less than 0.01 second, the program starts the cycle over again. Accordingly, the program continuously calculates and responds to any notes the organist plays.

By way of example, attached hereto as APPENDIX A is a listing of program instructions written in the FORTRAN language which embody the aforedescribed programming cycle. Other equivalent programs will suggest themselves to a person of ordinary skill in the art.

Obviously, numerous modifications and variations of the present invention are possible in light of the above teachings. For example, the invention may be applied to organ stops controlling percussions, both reiterating and non-reiterating, and electronic means for producing tones. It is therefore to be understood that within the scope of the appended claims, the invention may be practiced otherwise than as specifically described herein.

APPENDIX A

The following is a possible program embodying the program steps described for calculating which pipes should play in response to stop-key combinations. It is written in a modified FORTRAN language for micro-computers. The variable names used here correspond to those used in Figure 5 and in the text. Note that the values for S (the number of stop groups), M (the number of keyboards), and P (the number of pipe groups) as well as the data for OFFSET, FIRST, and LAST must be determined for each individual organ. Such determination will alter the numbers in the DIMENSION and DATA statements. For this program assume S is to be 15, M is to be 4, and P is to be 256 to agree with Figures 2A and 2B. Finally, assume that the input and output ports are numbered as follows: STOP group input ports are numbered 1 to 15; key group input ports are numbered 101 to 161; PIPE output latches are numbered 257 to 512.

A line that begins with C at the left is a comment card in FORTRAN. Such lines are not part of the program, but are included as comments to document and explain the program.

```
      PROGRAM RELAY
      IMPLICIT INTEGER (A-Z)
      DIMENSION  STOPS(15),OFFSET(15),FIRST(4),LAST(4),PIPES(256)
      DATA  M/4/, P/256/, S/15/
      DATA  OFFSET,FIRST,LAST/  data for specific organ  /
C  READ STOP SETTINGS INTO MEMORY.  I1TELLS WHICH PORT TO READ FROM
C  AND WHICH POSITION IN STOPS TO STORE THE DATA IN
C
1     DO 100  I1 = 1,S
100   READ(I1)STOPS(I1)
C
C  READ KEYS AND COMBINE WITH STOP SETTINGS TO DETERMINE WHICH PIPES
C  SHOULD PLAY
C
      DO 200  K = 1,61
C  KPORT TELLS WHICH KEY PORT TO READ DATA FROM
      KPORT = K + 100
      READ(KPORT) KEYGRP
      DO 50  J = 1,M
      L = KEYGRP  -  (KEYGRP/2)*2
      KEYGRP = KEYGRP/2
C
C  ABOVE BREAKS OUT LOWEST BIT OF KEYGRP TO L AND SHIFTS KEYGRP ONE
C  POSITION.  THAT IS, L RECIEVES THE VALUE OF KEY J IN THIS KEYGROUP
C  AND THE KEYGROUP IS SHIFTED IN PREPARATION FOR THE NEXT TIME AROUND
C  THE LOOP.
C
      IF( L .NE. 1)  GOTO 50
C  HERE IF KEY IS ON
      I22 = FIRST(J)
      M2  = LAST(J)
      DO 55  I2 = I22,M2
      N = K + OFFSET(I2)
55    PIPES(N) = PIPES(N)  .OR.  STOPS(I2)
```

```
50      CONTINUE
200     CONTINUE
C
C  WRITE CALCULATED PIPE SETTINGS TO LATCHES AND RESET PIPES
C  FOR NEXT PROGRAM CYCLE.  LPORT TELLS WHICH LATCH TO WRITE
C  DATA TO
C
        DO 300  I3 = 1,P
        LPORT = I3 + 256
        WRITE(LPORT) PIPES(I3)
300     PIPES(I3) = 0
C
C  NOW REPEAT THE PROGRAM CYCLE
C
        GOTO 1
        END
```

I claim as my invention:

1. In a unit pipe organ which includes a plurality of air-actuated pipes arranged in a plurality of ranks and a console for designating which of said plurality of pipes are to be played, said console including a plurality of keyboards each having a plurality of keys, and a plurality of stops associated with each keyboard, wherein a given rank of said pipes may be enabled by different stops on different keyboards, the improvement which comprises:

a unit organ relay means comprising a programmable data processor connected between said console and said plurality of pipes operating under the control of a program for calculating which of said pipes should be actuated in response to the key-stop combinations designated on said console.

2. The apparatus as set forth in claim 1, further comprising input interface means connected to said data processor which comprises:

first means for receiving an input in response to the actuation of each key; and second means for receiving an input in response to the actuation of each stop.

3. The apparatus as set forth in claim 2, further comprising output interface means connected between said data processor and said plurality of pipes for actuating the appropriate pipe in response to the output calculations of said programmable data processor.

4. The apparatus as set forth in claim 3, wherein said program controlled data processor comprises:

read-only-memory means for storing said program;

central processing means connected to said read-only-memory means and to said first and second input receiving means for operating on said inputs in response to the program instructions to calculate said output and to generate address signals; and random-access-memory means connected to said central processing means for storing said output and for feeding same upon demand to said output interface means.

5. The apparatus as set forth in claim 4, wherein said output interface means comprises a plurality of data latches each connected in parallel to receive the output calculations from said data processor, each of the plurality of outputs from said data latches connected to means for actuating an individual pipe among said plurality of pipes.

6. The apparatus as set forth in claim 5, wherein said output interface means further comprises a plurality of decoders connected to receive said address signals from said central processing means for controlling the sequential actuation of said plurality of data latches.

7. The apparatus as set forth in claim 2, wherein said first means comprises a plurality of first input ports each connected to read a single keygroup from said plurality of keyboards, and said second means comprises a plurality of second input ports each connected to read a single stop group from said plurality of stops.

8. In a pipe organ having a plurality of air pipes actuated by control means and arranged by rank and by pitch within each rank, a console having a plurality of keyboards, each keyboard having a plurality of keys and a plurality of stops associated therewith, a method of controlling the actuation of said pipes in response to particular key-stop combinations, which comprises the steps of:

(a) reading the setting of all stops into an electronic data storage device;

(b) successively testing each key on said plurality of keyboards to see if it is actuated;

(c) for each key found actuated pursuant to step (b), performing a logical AND operation between said actuated key and certain of said stop settings; and then (d) feeding the results of each said logical AND operation to said control means for said plurality of air pipes.

9. A method as set forth in claim 8, further comprising the step of recording the approximate pitch of each of said stops into said electronic data storage device, and wherein said step of performing a logical AND operation includes the step of determining the pitch of each of said certain stop settings.

10. A method as set forth in claim 8, wherein said step of performing a logical AND operation further comprises the step of selecting as said certain stop settings a subgroup of said stop settings which consists of only those stop settings corresponding to the particular keyboard having said actuated key.

11. A method as set forth in claim 8, wherein said step of successively testing each key includes the steps of:

grouping all of said keys from said plurality of keyboards into 61 keygroups, each keygroup consisting of all like notes from said plurality of keyboards; and successively testing each key by first checking each keygroup and then testing each key within said keygroup.

12. A method as set forth in claim 8, further comprising the step of establishing an array of data in an electronic memory device which corresponds to the desired condition of each of said air pipes, and updating said data array in response to each of said logical AND operations.

13. A method as set forth in claim 12, wherein said step of feeding the results of said logical AND operations to said air pipe control means comprises the step of reading out the contents of said data array to said control means after all of said keys have been tested.

14. A method as set forth in claim 8, wherein said step of reading the setting of all stops comprises the steps of arranging said stop settings in stop groups, each of said stop groups having a predetermined pitch associated therewith, and reading said stop group settings into a first data array in said storage device, and further including the steps of arranging the corresponding pitch for each stop group in a second data array and storing said second data array in a memory device, the pitch for each stop group being defined by the number of pipes between the first pipe in the stop group and the lowest pitch pipe within the rank of pipes that contains said stop group.

15. A method as set forth in claim 14, further comprising the step of establishing a third array of data in said memory device which corresponds to the desired condition of each of said air pipes, the rows of said third array corresponding to the rank of said air pipes, the individual columns of said third array identifying a particular pipe in each of said ranks.

16. A method as set forth in claim 15, wherein said step of performing a logical AND operation includes the steps of identifying from said first data array those stop groups containing stops that correspond to said actuated key, and successively performing said logical AND operation between each identified stop group and said actuated key.

17. A method as set forth in claim 16, wherein said step of successively performing said logical AND operation between each identified stop group and said actuated key further includes the steps of determining the desired pipe to be actuated by adding to the positional value of said actuated key the value from said second data array that corresponds to the pitch of said identified stop group, the sum thereof defining one of said columns in said third data array.

18. A method as set forth in claim 17, further comprising the step of updating said defined column in said third data array by performing a logical OR operation between the previously stored data for said column and the data from said first data array corresponding to said identified stop group.

19. Apparatus adapted to be used with a pipe organ having a plurality of air-actuated pipes and a console for designating which of said plurality of pipes are to be played, said console including a plurality of keyboards each having a plurality of keys, and a plurality of stops associated with each keyboard, which comprises:

means connected between said console and said plurality of pipes for receiving input signals from said console indicative of which of said plurality of keys and stops have been actuated by a player of said organ, for determining a set of pipes from said plurality of air-actuated pipes which are to be sounded in response to said input signals, and for providing output signals to said set of pipes for causing same to be sounded; said means comprising a digital data processor operating under the control of a program.

20. In a pipe organ having a plurality of air pipes actuated by control means and arranged by rank and by pitch within each rank, a console having a plurality of keyboards, each keyboard having a plurality of keys and a plurality of stops associated therewith, a method of controlling the actuation of said pipes in response to particular key-stop combinations, which comprises the steps of:

feeding input signals representing the setting of stops and keys from said console into a digital data processor operating under the control of a program;

determining in said data processor a set of pipes from among said plurality of pipes that should be activated in response to said input signals; and providing output signals representing said set of pipes from said data processor to said control means, said control means operating to sound said set of pipes.

* * * * *